US006232857B1

(12) United States Patent
Mason, Jr. et al.

(10) Patent No.: US 6,232,857 B1
(45) **Date of Patent: *May 15, 2001**

(54) ARC FAULT CIRCUIT BREAKER

(75) Inventors: Henry H. Mason, Jr., Farmington; Raymond K. Seymour, Plainville; Frederic W. Glabau, Kensington; Douglas B. Tilghman, Bristol; Joseph L. Desormeaux, Jr., Farmington; Michael C. Guerrette, East Bristol, all of CT (US)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/397,684

(22) Filed: Sep. 16, 1999

(51) Int. Cl.[7] ..... H01H 73/00; H01H 75/00; H01H 83/06

(52) U.S. Cl. ..... 335/18; 361/42; 335/35

(58) Field of Search ..... 335/18, 25; 361/42–51, 361/167–176

(56) References Cited

U.S. PATENT DOCUMENTS

| | | |
|---|---|---|
| 3,401,363 | 9/1968 | Vyskocil et al. . |
| 3,443,258 | 5/1969 | Dunham et al. . |
| 3,596,218 | 7/1971 | Layton . |
| 3,596,219 | 7/1971 | Erickson . |
| 4,081,852 | 3/1978 | Coley et al. . |
| 4,208,690 | 6/1980 | McGinnis et al. . |
| 4,345,288 | 8/1982 | Kampf et al. . |
| 4,468,071 | 8/1984 | Russell, Jr. . |
| 4,513,268 | 4/1985 | Seymour et al. . |
| 4,513,342 | 4/1985 | Roche . |

(List continued on next page.)

FOREIGN PATENT DOCUMENTS

| | | |
|---|---|---|
| 2036032 | 8/1981 | (CA) . |
| WO 91/13464 | 9/1991 | (WO) . |
| WO 95/20235 | 7/1995 | (WO) . |

*Primary Examiner*—Lincoln Donovan
*Assistant Examiner*—Tuylen T. Nguyen
(74) *Attorney, Agent, or Firm*—Cantor Colburn LLP; Carl B. Horton

(57) ABSTRACT

An arc fault circuit breaker (10) conducting an electric current to a protected load is presented. The circuit breaker (10) has a first (mechanical) compartment (24) and a second (electrical) compartment (62). A bimetal resistor (50) is disposed within the first compartment (24) and conducts the current therethrough. The bimetal resistor (50) has a stud (56) extending into the second compartment (62). A single sense line (60) is electrically connected to the bimetal resistor (50) and routed into the second compartment (62). The sense line (60) and said stud (56) conduct a voltage signal indicative of arcing of the current. A circuit board (84) is disposed within the second compartment (62) and is connected to the sense line (60) and stud (56) within the second compartment (62) to process the voltage signal. The circuit board (84) has a first conductive path (104) electrically connected to the stud (56), and a second conductive path (106) electrically connected to the sense line (60). The first and second conductive paths (104,106) run substantially parallel and proximate to each other such that electromagnetic interference of the voltage signal is substantially reduced.

14 Claims, 3 Drawing Sheets

U.S. PATENT DOCUMENTS 4,552,018 11/1985 Legetti et al. .
4,568,899 * 2/1986 May et al. ..... 335/18
4,573,259 3/1986 Seymour et al. .
4,589,052 5/1986 Dougherty .
4,598,183 7/1986 Gardner et al. .
4,641,216 2/1987 Morris et al. .
4,641,217 2/1987 Morris et al. .
4,658,322 4/1987 Rivera .
4,667,253 5/1987 Morris et al. .
4,672,501 6/1987 Bilac et al. .
4,686,600 8/1987 Morris et al. .
4,688,134 8/1987 Freeman et al. .
4,702,002 10/1987 Morris et al. .
4,847,850 7/1989 Kafka et al. .
4,878,143 10/1989 Kalai et al. .
4,878,144 10/1989 Nebon .
4,931,894 6/1990 Legatti .
4,936,894 6/1990 Larson et al. .
5,089,796 2/1992 Glennon et al. .
5,121,282 6/1992 White .
5,185,684 2/1993 Belhoff et al. .
5,185,685 2/1993 Tennles et al. .
5,185,686 2/1993 Hansen et al. .
5,185,687 2/1993 Belhoff et al. .
5,206,596 4/1993 Belhoff et al. .
5,208,542 5/1993 Tennies et al. .
5,223,682 6/1993 Pham et al. .
5,224,006 6/1993 MacKenzie et al. .
5,229,730 7/1993 Legatti et al. .
5,245,498 9/1993 Uchida et al. .
5,246,302 9/1993 Brune et al. .
5,250,916 10/1993 Edds et al. .
5,299,730 4/1994 Pasch et al. .
5,303,113 4/1994 Goleman et al. .
5,307,230 4/1994 MacKenzie .
5,358,293 10/1994 Boksiner et al. .
5,416,463 5/1995 Fleming et al. .
5,420,740 5/1995 MacKenzie et al. .
5,430,247 7/1995 Bockelman .
5,432,455 7/1995 Blades .
5,434,509 7/1995 Blades .
5,452,223 9/1995 Zuercher et al. .
5,453,723 9/1995 Fello et al. .
5,459,630 10/1995 MacKenzie et al. .
5,475,609 12/1995 Apolhaker .
5,483,211 * 1/1996 Carrodus et al. ..... 335/18
5,485,093 1/1996 Russell et al. .
5,493,278 2/1996 MacKenzie et al. .
5,506,769 4/1996 Russell et al. .
5,510,946 4/1996 Franklin .
5,510,949 4/1996 Innes .
5,512,832 4/1996 Russell et al. .
5,519,561 5/1996 Mrenna et al. .
5,546,266 8/1996 MacKenzie et al. .
5,550,751 8/1996 Russell .
5,561,805 10/1996 Zuercher et al. .
5,578,931 11/1996 Russell et al. .
5,583,732 12/1996 Seymour et al. .
5,590,012 12/1996 Dollar, II .
5,600,526 2/1997 Russell et al. .
5,614,878 3/1997 Patrick et al. .
5,615,075 3/1997 Kim .
5,628,824 5/1997 Rankin et al. .
5,659,453 8/1997 Russell et al. .
5,694,101 12/1997 Lavelle et al. .
5,706,154 1/1998 Seymour .
5,818,671 * 10/1998 Seymour et al. ..... 361/42
5,831,500 11/1998 Turner et al. .
5,831,509 * 11/1998 Elms et al. ..... 335/18

* cited by examiner

ARC FAULT CIRCUIT BREAKER

BACKGROUND OF THE INVENTION

The present invention relates generally to a circuit breaker. More specifically the present invention relates to an arc fault circuit breaker, wherein voltage is sensed across a bimetallic element and processed by current sensing components to detect the existence of an arc fault.

Arc fault circuit breakers typically comprise a pair of separable contacts that open (trip) upon sensing an arcing current from line to ground, and/or from line to neutral. Arc fault circuit breakers typically use a differential transformer to measure arcing from line to ground. Detecting arcing from line to neutral is accomplished by detecting rapid changes in load current by measuring voltage drop across a relatively constant resistance, usually a bimetallic element (bimetal). Additionally, during over current conditions (i.e., above rated current) the bimetal heats up and flexes a predetermined distance to engage a primary tripping mechanism and trip the circuit breaker.

Components of arc fault circuit breakers are generally assembled into separate compartments as defined by their function. More specifically, mechanical components (e.g., load current carrying and switching components) of each pole are assembled into mechanical compartments, while the current sensing components are assembled into an electronics compartment. In order to connect the compartments, the load current of each pole must be routed from the mechanical compartments into the electronics compartment, through appropriate current sensing devices, and back into the mechanical compartments. Additionally, conductors or sensing lines (e.g., wires connected to the bimetal), must also be routed from the mechanical compartment into the electronics compartment.

The bimetal has a dual function. First, it engages the circuit breaker's primary tripping mechanism to trip the circuit breaker during over current conditions (e.g., above its rated current of 10, 15 or 20 amps). Second, it also detects multiple, instantaneous, high-current arcing (e.g., 70 to 500 amps or more) from line to neutral.

For the first function, the bimetal is constructed of a pair of dissimilar metallic strips having different coefficients of expansion. When the bimetal conducts current, the dissimilar metallic strips heat up and expand at different rates, causing the bimetal to flex proportionally to the current conducting through it. The bimetal is calibrated to flex a predetermined distance during over current conditions to engage and activate the tripping mechanism. This, however, requires a relatively large amount of space within an already cramped mechanical compartment to accommodate the free movement of the bimetal. This problem is exacerbated by having too many connections attached to the bimetal which must also be allowed to move freely as the bimetal flexes. Additionally, making too many connections to the bimetal during assembly may bend the bimetal enough to throw it out of calibration. Therefore it is desirable to keep to a minimum, the number of connections to the bimetal.

The second function utilizes the relatively constant resistance of the bimetal. The voltage drop across the bimetal, is sensed by sensing lines and processed by circuitry (e.g., a printed circuit board) located in the electronics compartment to detect the arcing. When voltage drops indicative of arcing are detected, the circuitry generates a trip signal to activate the tripping mechanism and trip the circuit breaker. However, voltage drops indicating an arc fault are small and rapid, and can be imitated by electromagnetic interference (EMI) in the sensing lines. If the sensing lines are not properly protected, EMI may cause the sensing circuitry to trip the circuit breaker without the occurrence of arcing (false trip).

In order to reduce the effects of EMI on prior art circuit breakers a pair of sensing lines (e.g., wires) are first connected to the printed circuit board at assembly. The lines are then twisted together to offset the effects of EMI before they are routed through appropriate openings into the mechanical compartment, where they are connected across the bimetal. However, the twisting process is labor intensive and problematically adds to the cost of assembly.

In an alternative prior art embodiment, a pair of shielded wires (e.g., coaxial cables) are used as sensing lines to reduce the effects of EMI. However, shielded wires are expensive and still require connecting two wires across the bimetal in the cramped mechanical compartment, which can result in disturbing the sensitive calibration of the bimetal.

BRIEF SUMMARY OF THE INVENTION

In an exemplary embodiment of the invention, an arc fault circuit breaker conducting an electric current to a protected load comprises a pair of separable contacts for interrupting the current to the protected load. A first housing of the circuit breaker has a first compartment enclosing the pair of separable contacts. A second housing of the circuit breaker has a second compartment and a first opening. The second housing is assembled to the first housing to enclose the first compartment. A bimetallic element is disposed within the first compartment and conducts the current therethrough. A stud extends from the bimetallic element into the second compartment through the first opening. A conductor electrically connects to the bimetallic element and is routed into the second compartment through the first opening. The conductor and the stud conduct a voltage signal indicative of the current. A circuit board is disposed within the second compartment, and electrically connects to the conductor and the stud within the second compartment, wherein the circuit board processes the signal.

In alternative exemplary embodiment of the invention, the circuit breaker comprises a first conductive path disposed on the circuit board. The first conductive path electrically connects to the stud for conducting the voltage signal. A second conductive path disposed on the circuit board electrically connects to the conductor for conducting the voltage signal. The first and second conductive paths run substantially parallel and proximate to each other for a predetermined distance.

BRIEF DESCRIPTION OF THE DRAWINGS

Referring now to the drawings wherein like elements are numbered alike in the several Figures.

DETAILED DESCRIPTION OF THE INVENTION

Figure 1:
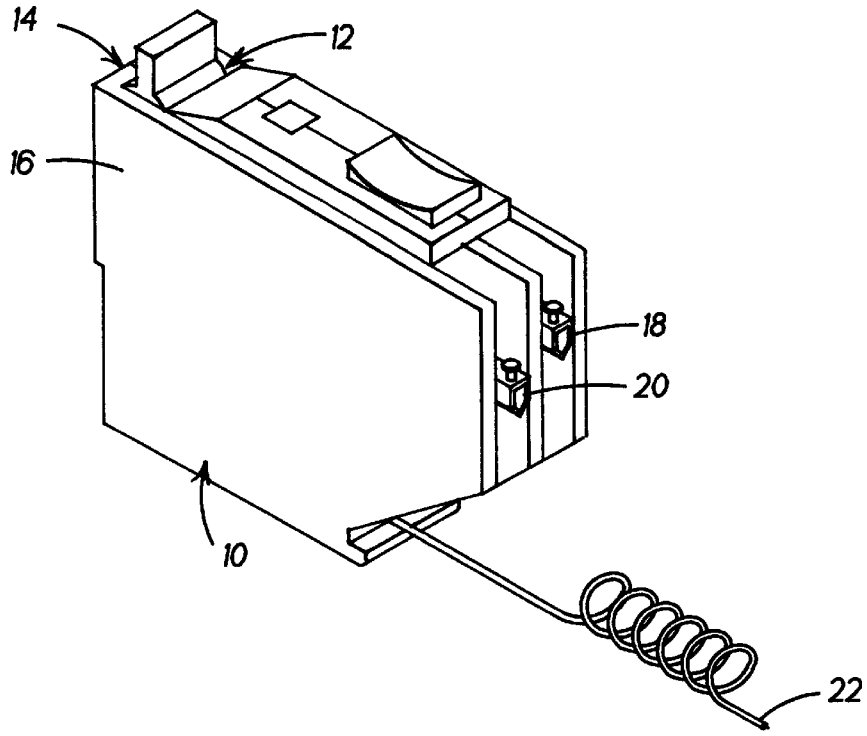
FIG. 1 is a perspective view of a circuit breaker in an exemplary embodiment of the present invention.
Figure 2:
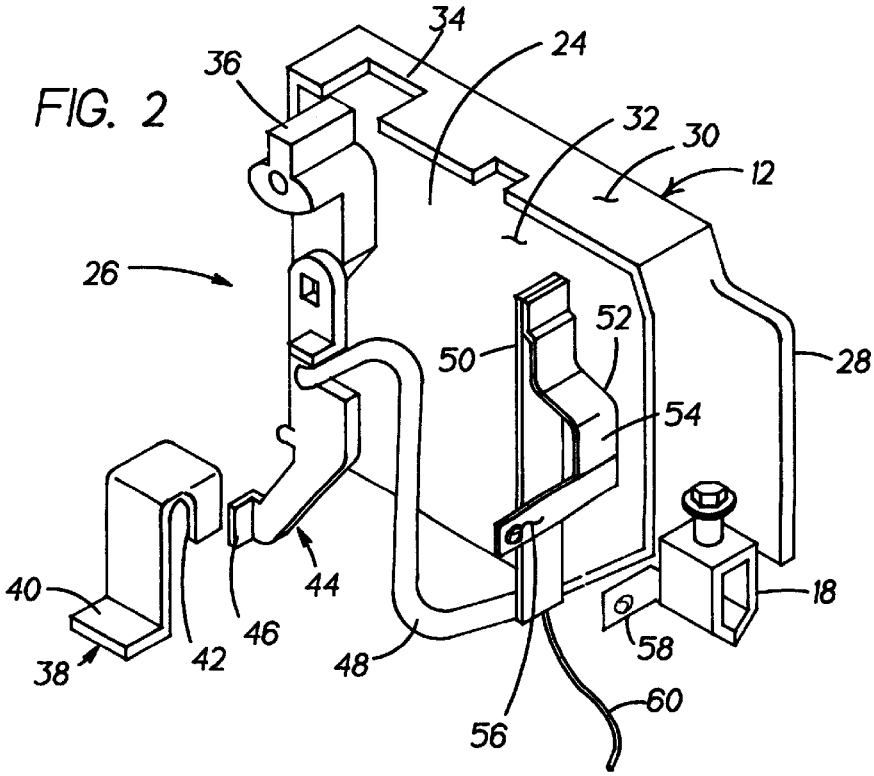
FIG. 2 is an exploded view of the mechanical compartment of the circuit breaker of FIG. 1.
Figure 3:
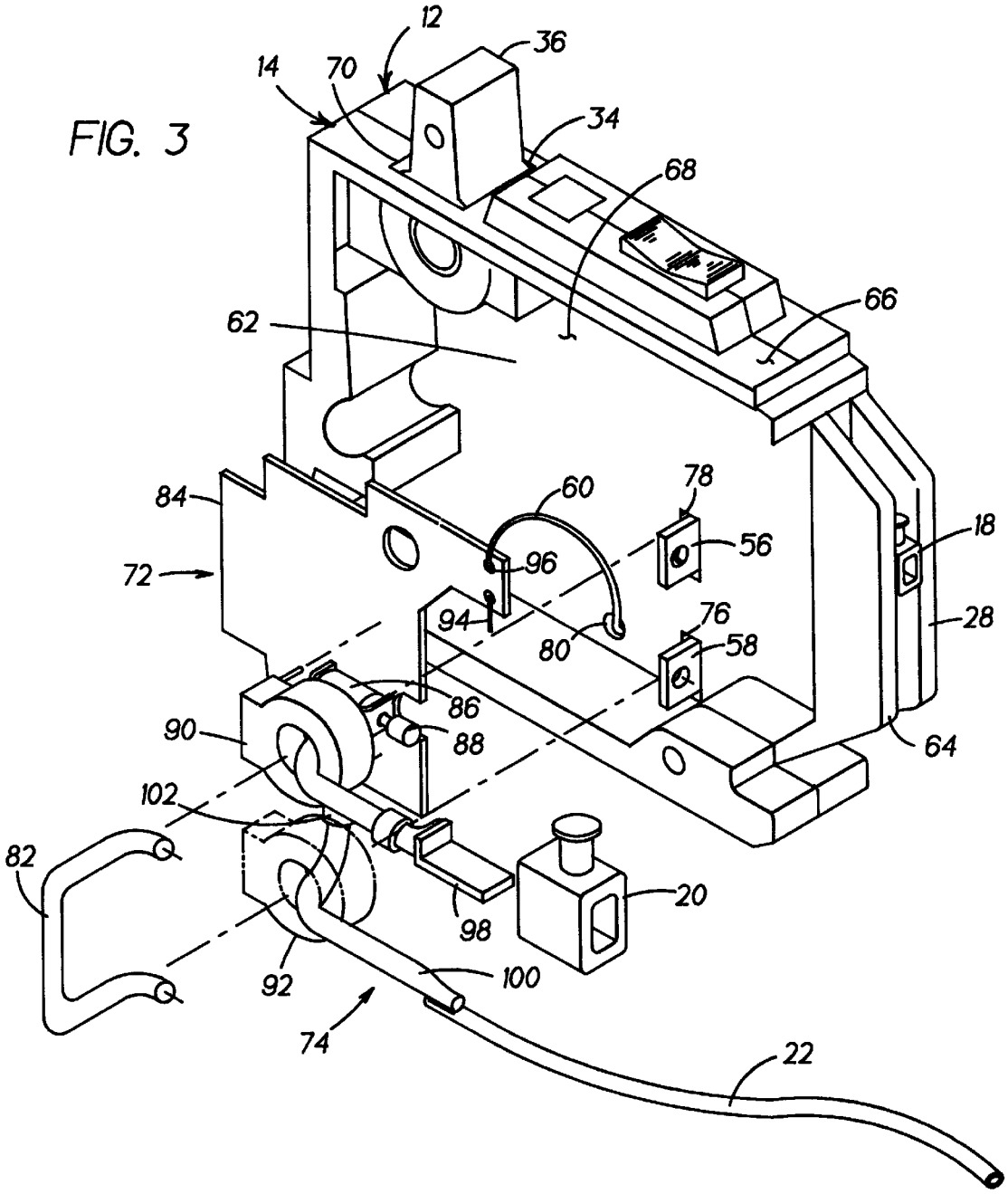
FIG. 3 is an exploded view of the electronics compartment of the circuit breaker of FIG. 1.

Referring to FIGS. 1, 2, and 3, an exemplary embodiment of a fully assembled, single pole, arc fault circuit breaker is shown generally at 10. Circuit breaker 10 comprises a first housing 12, a second housing 14, and a cover 16 that are assembled securely together with a plurality of permanent fasteners (not shown). First housing 12 defines a mechanical compartment 24, having load current carrying and switching components 26 disposed therein (see FIG. 2). Second housing 14 defines an electronics compartment 62, having current sensing components 72 and neutral current carrying components 74 disposed therein (see FIG. 3). A load current from a source (not shown) connects to line connection 38 (see FIG. 2), and conducts along the current carrying and switching components 26 to load lug 18 for customer connection to a load (not shown). A neutral current from the load connects to neutral lug 20 (see FIG. 3), and conducts along the neutral current carrying components 74 to neutral return wire 22 for customer connection to the source. Arc faults are sensed and processed by sensing components 72.

Referring to FIG. 2, the mechanical compartment 24 is shown in detail. First housing 12 is generally rectangular in shape, and formed of electrical insulative material (i.e., plastic). First housing 12 comprises first insulative tab 28, first rim 30, and first side wall 32. First tab 28 protrudes forwardly from the front of first housing 12 adjacent load lug 18 to provide an insulative barrier. First rim 30 extends around the periphery of first side wall 32. A first rectangular slot 34 is located in rim 30 at the top and rear of first housing 12 and sized to receive pole handle 36. First side wall 32 and first rim 30 define the mechanical compartment 24 which includes the load current carrying and switching components 26. The load current carrying and switching components 26 within the mechanical compartment 24 are electrically connected (e.g., welded, bolted, or crimped) to form a load current path. The load current path begins at line connection 38 where the load current enters the mechanical compartment 24. Line connection 38 includes a lower tab 40 to connect to a source line (not shown), and a fixed contact 42 which extends downwardly from the upper end of line connection 38. Blade 44 is pivotally engaged to the first housing 12 and pivotally attached to insulated pole handle 36. A lower end of blade 44 includes a flat contact point 46 which is forcibly biased against contact point 42 to provide electrical continuity for the load current. Pole handle 36 is pivotally attached to first housing 12 and extends outwardly from mechanical compartment 24 into the electronics compartment 62 (see FIG. 3).

Blade 44 is electrically connected to a bottom end of bimetal element (bimetal) 50 via braided wire 48. A top end of bimetal 50 is, in turn, electrically connected to L-shaped strap 52. L-shaped strap 52 comprises a vertical strap body 54 and a horizontal stud extension 56. Horizontal stud 56 is substantially perpendicular to vertical strap body 54, and extends outwardly from mechanical compartment 24 into electronics compartment 62 as shown in FIG. 3. Load terminal 58 also extends outwardly from the mechanical compartment 24 into electronics compartment 62. Load terminal 58 is, in turn, electrically connected to the load lug 18. The load current path conducts the load current from the line connection 38, through contacts 42 and 46, through blade 44, braid 48, bimetal 50, and L-shaped strap 52. At this point, the load current path passes out of the mechanical compartment 24 through horizontal strap extension 56. The load current path returns to the mechanical compartment 24 through load terminal 58 and out through the load lug 18 to the load. When an arc fault is detected, the pole handle 36 pivots clockwise under the force of a tripping mechanism (not shown), causing blade 44 to pivot and separate contact points 42 and 46, thereby opening the load current path.

Bimetal 50 has a dual function. It engages and activates the primary tripping mechanism (not shown) for tripping the circuit breaker 10 during over current conditions (e.g., above the circuit breaker's rated current of 10 amps 15 amps or 20 amps). By utilizing the different expansion rates of its bimetal construction, the bimetal is calibrated to flex a predetermined distance at the circuit breaker's rated current. Once the rated current is exceeded, any additional flexing of the bimetal will engage and activate the tripping mechanism of the circuit breaker. Additionally, bimetal 50 provides relatively constant resistance in series with the current path. Therefore, the voltage drop across the bimetal is indicative of the current in the current path. Arcing from line to neutral results in rapid current changes (e.g., 70 to 500 amps peak) in the current path, which can be sensed as rapidly changing voltage across the bimetal.

Detecting arc faults from line to neutral is accomplished by sensing the rapidly changing voltage across the bimetal 50. The voltage sensed is by electrically connecting (e.g., welding) a single wire (sense line or conductor) 60 from the bottom end of bimetal 50 to the current sensing components 72 in the electronics compartment 62. Additionally, the top end of bimetal 50 is connected to the current sensing components 72 through the horizontal stud extension 56 to provide a return path for the voltage signal. Advantageously, by utilizing stud extension 56, the number of sensing lines welded to the bimetal is reduced to a single line 60, as opposed to a pair of lines in prior art circuit breakers. This significantly reduces the number of connections made to the bimetal during assembly and, consequently, the risk of bending the bimetal and disturbing its sensitive calibration. Also, by reducing the number of connections to the bimetal, the problem of having to accommodate the free movement of the connections as the bimetal flexes is correspondingly reduced.

Referring to FIG. 3, the electronics compartment 62 is shown in detail. Second housing 14 is generally rectangular in shape and formed of electrical insulative material, i.e., plastic. Second housing 14 comprises second insulative tab 64, second rim 66, and second side wall 68. Second tab 64 protrudes forwardly from the front of second housing 14 adjacent neutral lug 20 to provide an insulative barrier. Second rim 66 extends around the periphery of second side wall 68. A second rectangular slot 70 is located in rim 66 and cooperates with slot 34 to receive and secure pole handle 36 when housings 12 and 14 are assembled together. Second side wall 68 and second rim 66 define the electronics compartment 62 which includes the current sensing components 72 and the neutral current carrying components 74. The second housing 14 is assembled securely against first housing 12 with a plurality of permanent fasteners (not shown). When secured against first housing 12, second housing 14 encloses mechanical compartment 24 and insulates and secures load lug 18 between tabs 28 and 64.

Second side wall 68 of second housing 14 includes rectangular through holes 76 and 78 and circular through hole 80 to provide openings in the second housing 14 to permit the load terminal 58, horizontal stud 56 and wire 60 respectively, to extend through to the electronics compartment 62. The load current path is completed by electrically connecting stud 56 and load terminal 58 to the respective ends of the wire connector 82.

Current sensing components 72 comprise circuit board 84, which is electrically connected to solenoid 86, current sensing transformer 90, and optional current sensing transformer 92. Printed circuit board 84 is connected across the bimetal 50 by connecting, e.g., welding, square post 94 of printed circuit board 84 to wire connector 82 proximate the electrical connection between wire connector 82 and stud 56. Additionally, wire 60 from the bottom end of bimetal 50 is connected (e.g., welded) to stake 96 on printed circuit board 84. When an arc fault occurs from line to neutral, voltage across bimetal 50 changes rapidly. These rapid voltage changes are sensed by wire 60 and stud 56, which are connected across bimetal 50. Upon receiving the signals from wire 60 and stud 56, circuit board 84 amplifies and processes the voltage signal, and provides a trip signal to a solenoid 86 to trip the arc fault circuit breaker 10.

Figure 4:
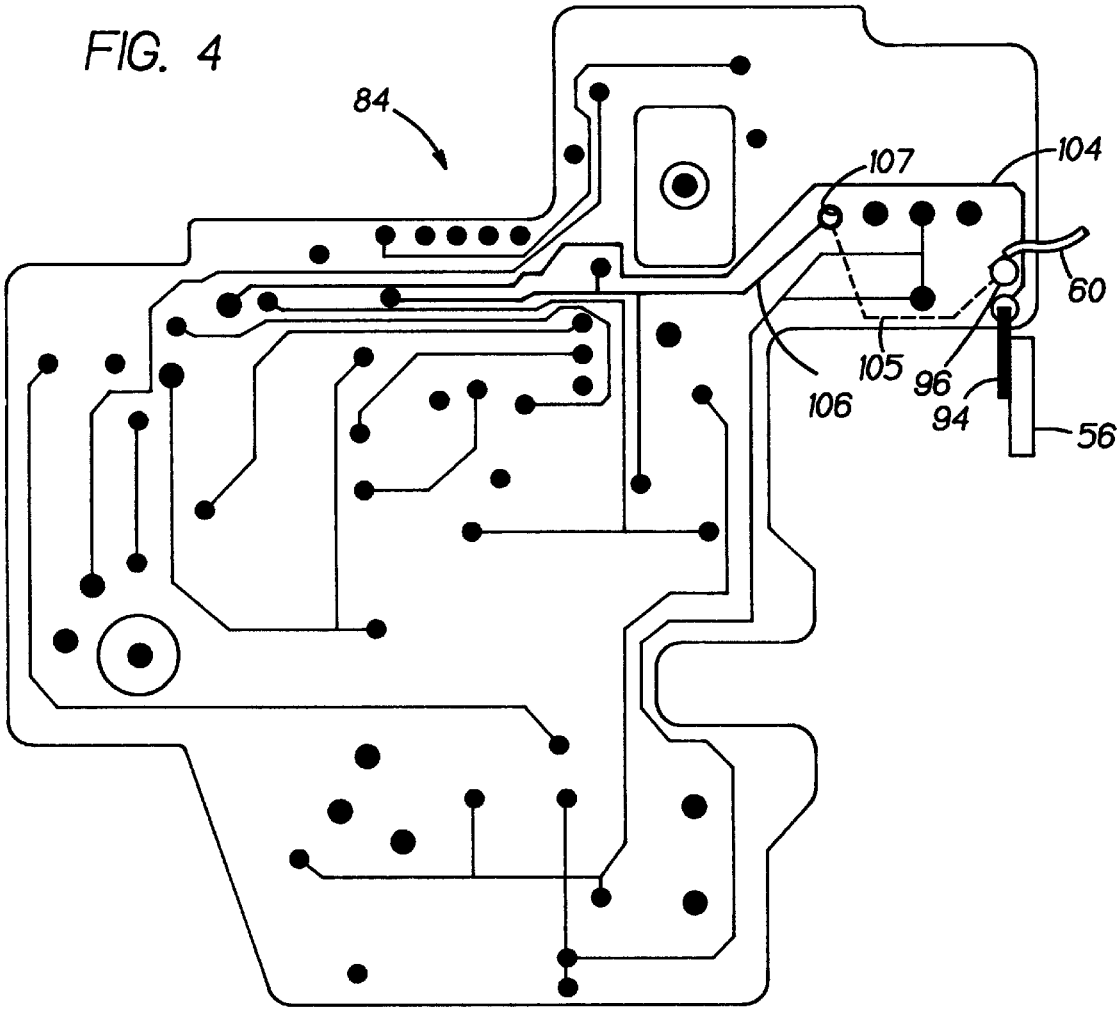
FIG. 4 is schematic view of the printed circuit board of the circuit breaker of FIG. 3 in an exemplary embodiment of the present invention.

As more particularly discussed hereinafter, conductive paths (traces) 104, 105 and 106 on circuit board 84 (as shown in FIG. 4) receive the voltage signal to be processed by circuit board 84. Traces 104 and 106 are run substantially parallel and proximate to each other. This significantly reduces the effects of EMI on the voltage signals from bimetal 50, and prevents false trips. Unlike prior art circuit breakers, circuit board 84 advantageously eliminates the requirement to use expensive twisted or shielded (e.g., coaxial) wires to reduce EMI.

Solenoid 86 comprises trip rod 88 for engaging the trip mechanism (not shown) to pivot the pole handle 36 in response to the trip signal, and provides the means to trip the circuit breaker 10 under arc fault conditions. That is, when an arc fault is sensed, circuit board 84 generates a trip signal to actuate solenoid 86, which extends the trip rod 88 to activate the trip mechanism which pivots pole handle 36. The pole handle 36 pivots, which in turn pivots blade 44 to separate contacts 42 and 46 and thereby opens the load current path.

The neutral current carrying components 74 within the electronics compartment 62 are electrically connected (e.g., welded, bolted, or crimped) to form a neutral current path for the neutral current. The neutral current path begins at neutral lug 20 where the neutral current enters the electronics compartment 62. Neutral lug 20 secures the neutral lead connected to the load (not shown) against neutral terminal 98 to provide electrical continuity thereto. Neutral terminal 98 is electrically connected to neutral return wire 22 via copper braid 100. Insulated sleeve 102 surrounds a portion of copper braid 100 and provides electrical insulation between copper braid 100 and sense line 60. Copper braid 100 is routed through the center of sensing transformer 90 such that the flow of the neutral current through the center of transformer 90 is in the opposite direction of the flow of the load current through lead 82.

Both the copper braid 100 of the neutral current path, and wire connector 82 of the load current path are routed through the current sensing transformer 90 to sense fault currents from line to ground as is well known. This is accomplished by routing the flow of the neutral current through the sensing transformer 90 in the opposite direction to the flow of the load current. The total current flow through sensing transformer 90 thus cancels unless an external ground fault current is caused by arcing from line to ground. The resulting differential current, sensed by sensing transformer 90, is indicative of the ground fault current and is processed by circuit board 84. Arcing from line to ground is thereby detected.

Optional oscillating current transformer 92 is used for ground fault applications where a method is needed to detect improper wiring by the customer (e.g., the neutral current path is wired backwards). Copper braid 100 of the neutral current path is routed through the optional oscillating current transformer 92. The resulting signal, injected by oscillating current transformer 92 and sensed by current sensing transformer 90, is indicative of the neutral current resulting from improper wiring, and is processed by circuit board 84.

Referring to FIGS. 3 and 4, a detailed schematic of the conductive paths (traces) 104, 105 and 106 on circuit board 84 are shown in FIG. 4. Wire 60 from the bottom end of bimetal 50 is connected to stake 96. The voltage signal from the bimetal 50 travels through the stake 96 onto circuit board 84. Once on the circuit board 84, the signal travels along the conductive path formed by traces 105 and 106. Trace 105 (shown as a dotted line) is located on the opposite side of board 84 relative to trace 106, and connects stake 96 to trace 106 at through-hole 107. Trace 105 is located on the opposite side of board 84 to avoid contact with other components (not shown). Substantially parallel and proximate to trace 106 is trace 104, which provides the return path for the voltage signal back through square post 94. Stud 56 is welded directly to square post 94 and acts as a grounding conductor to carry the voltage signal back to the top end of bimetal 50 through L shaped strap 52 (shown in FIG. 1). Preferably, traces 104 and 106 are proximate to each other by a distance ranging from 0.8 mm to 1 mm, and run substantially parallel to each other to their points of termination. By placing traces 104 and 106 substantially parallel and proximate to each other, the effective coupling area (antenna) of traces 104 and 106 is minimized and, therefore, the possibility of EMI coupling is substantially reduced. Additionally, stud 56 further reduces the possibility of EMI coupling by eliminating a wire that would act as an antenna for the input signal. This significantly reduces the possibility of generating false trip signals due to EMI coupling. Advantageously, this eliminates the need to use expensive shielded wire, e.g., coaxial cable, or time consuming twisted pair wire to connect printed circuit board 84 to bimetal 50. Therefore, the time and cost of assembly is significantly reduced from that of the prior art.

While the exemplary embodiment of the conductive paths on the circuit board 84 are shown as traces, one skilled in the art would recognize that the invention can apply to other conductive paths as well, e.g., embedded wires. While the exemplary embodiment of arc fault circuit breaker 10 is shown as a single pole circuit breaker, one skilled in the art would recognize that the invention can apply to multi-pole circuit breakers as well (e.g., two or three pole).

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments failings within the scope of the appended claims.

What is claimed:

1. An arc fault circuit breaker conducting an electrical current to a protected load, said circuit breaker comprising:

a pair of separable contacts for interrupting said current to said protected load;

a first housing having a first compartment enclosing said pair of separable contacts;

a second housing having a second compartment and having at least one opening, communicating between said first compartment and said second compartment, said second housing assembled to said first housing to enclose said first compartment;

a bimetallic element having a resistance thereby generating a voltage signal indicative of the current, said bimetallic element disposed within said first compartment and conducting said current therethrough;

a stud extending from said bimetallic element into said second compartment through said at least one opening;

a conductor electrically connected to said bimetallic element and routed into said second compartment through said at least one opening, said conductor and said stud conducting said voltage signal indicative of said current; and a circuit board having a circuit thereon disposed within said second compartment, said circuit board electrically connected to said conductor and said stud, wherein said circuit board processes said voltage signal to determine if a fault or over current condition exists.

2. The arc fault circuit breaker of claim 1 wherein said circuit board comprises:

first conductive path disposed on said circuit board, said first conductive path electrically connected to said stud for conducting said voltage signal; and a second conductive path disposed on said circuit board, said second conductive path electrically connected to said conductor for conducting said voltage signal; wherein said first and second conductive paths run substantially parallel and proximate to each other for a predetermined distance.

3. The arc fault circuit breaker of claim 1 wherein said bimetallic element is calibrated to flex a predetermined distance when a predetermined current threshold is reached.

4. The arc fault circuit breaker of claim 1 wherein said circuit board processes said voltage signal to detect arcing of said current, said circuit board generating a trip signal to trip said circuit breaker when said arcing is detected.

5. The arc fault circuit breaker of claim 1 wherein said conductor comprises a wire.

6. The arc fault circuit breaker of claim 1 wherein said at least one opening comprises a first opening having said stud extend therethrough, and a second opening having said conductor routed therethrough.

7. The arc fault circuit breaker of claim 2 wherein said first and second conductive paths are traces disposed on said circuit board.

8. An arc fault circuit breaker conducting an electric current to a protected load, said circuit breaker comprising:

a pair of separable contacts for interrupting said current to said protected load;

a first housing having a first compartment enclosing said pair of separable contacts;

a second housing having a second compartment and having at least one opening, said second housing assembled to said first housing to enclose said first compartment;

a bimetallic element having a resistence thereby generating a voltage signal indicative of the current, said bimetallic element disposed within said first compartment and conducting said current therethrough; and a circuit board having a circuit thereon disposed within said second compartment and electrically connected to said bimetal element via a conductor through said at least one opening, said circuit breaker including first and second conductive paths disposed on said circuit board to receive said voltage signal for processing by said circuit on said circuit board to determine if a fault or over current condition exists, wherein said first and second conductive paths run substantially parallel and proximate to each other for a predetermined distance.

9. The arc fault circuit breaker of claim 8 wherein said bimetallic element is calibrated to flex a predetermined distance when a predetermined current threshold is reached.

10. The arc fault circuit breaker of claim 8 wherein said circuit board processes said voltage signal to detect arcing of said current, said circuit board generating a trip signal to trip said circuit breaker when said arcing is detected.

11. The arc fault circuit breaker of claim 8 wherein said conductor comprises a wire.

12. The arc fault circuit breaker of claim 8 wherein said conductor comprises a pair of twisted or shielded wires.

13. The arc fault circuit breaker of claim 8 wherein said first and second conductive paths are traces disposed on said circuit board.

14. The arc fault circuit breaker of claim 10 wherein said arcing is from line voltage to neutral voltage of said current.

* * * * *